US008534254B2

(12) United States Patent
Ziegs et al.

(10) Patent No.: US 8,534,254 B2
(45) Date of Patent: Sep. 17, 2013

(54) STARTER DEVICE

(75) Inventors: Carsten Ziegs, Hamburg (DE); Boris Kaun, Luebeck (DE)

(73) Assignee: Dolmar GmbH, Hamburg (DE)

( * ) Notice: Subject to any disclaimer, the term of this patent is extended or adjusted under 35 U.S.C. 154(b) by 706 days.

(21) Appl. No.: 12/588,682

(22) Filed: Oct. 23, 2009

(65) Prior Publication Data

US 2010/0126455 A1 May 27, 2010

(30) Foreign Application Priority Data

Nov. 27, 2008 (DE) ..... 20 2008 015 755 U

(51) Int. Cl.
*F02N 1/00* (2006.01)

(52) U.S. Cl.
USPC ..... 123/185.3; 123/185.1; 123/185.2; 123/185.4; 123/185.5

(58) Field of Classification Search
USPC ..... 123/185.1, 185.15, 185.2, 185.3, 123/185.4, 185.5
See application file for complete search history.

(56) References Cited

U.S. PATENT DOCUMENTS

| | | | | | |
|---|---|---|---|---|---|
| 2,323,535 | A | * | 7/1943 | Gorden | 123/185.3 |
| 2,643,750 | A | * | 6/1953 | Moulton | 192/48.1 |
| 3,306,277 | A | * | 2/1967 | Gudmundsen | 123/185.14 |
| 3,741,170 | A | * | 6/1973 | Hinckley | 123/225 |
| 3,744,468 | A | * | 7/1973 | Braun | 123/185.2 |
| 4,019,490 | A | * | 4/1977 | Reese | 123/185.2 |
| 4,370,954 | A | * | 2/1983 | Asao et al. | 123/182.1 |
| 4,426,961 | A | * | 1/1984 | Grinde | 123/179.26 |
| 4,480,605 | A | * | 11/1984 | Bloemers | 123/185.3 |
| 4,492,190 | A | * | 1/1985 | Greenwood et al. | 123/185.2 |
| 4,582,030 | A | * | 4/1986 | Reese | 123/185.3 |

(Continued)

FOREIGN PATENT DOCUMENTS

| | | | |
|---|---|---|---|
| CN | 1 594 870 | A | 3/2005 |
| CN | 1 696 494 | A | 11/2005 |
| DE | 197 25 901 | A1 | 1/1998 |
| EP | 1 203 883 | A2 | 5/2002 |

OTHER PUBLICATIONS

German Search Report issued in German Patent Application No. 20 2008 015 755.2 on Nov. 12, 2009 (w/ English-language translation).

(Continued)

*Primary Examiner* — Stephen K Cronin
*Assistant Examiner* — Raza Najmuddin
(74) *Attorney, Agent, or Firm* — Oliff & Berridge, PLC

(57) ABSTRACT

In order to create a starter device (100) for an internal combustion engine of a manually guided engine unit, wherein the device comprises a housing (10) and a cable drum (11) which can be rotated relative to the housing (10) about a rotational axis with a starter pull for starting the engine, and has a recoil spring space (14), which is arranged between the housing (10) and the cable drum (11), for a recoil spring (13), in order to move the cable drum (11) into its original position after a rotational movement of the starter, wherein sealing of the recoil spring space (14) is provided, which starter device on the one hand prevents dirt from penetrating into the recoil spring space and on the other hand has a simple design, it is proposed that the seal (15) is spaced apart radially from the rotational axis (X) to such an extent that the recoil spring space (14) is formed by a wall (16) of the cable drum (11) and an approximately opposite wall (17) of the housing (10).

12 Claims, 2 Drawing Sheets

(56) References Cited

U.S. PATENT DOCUMENTS

| | | | | |
|---|---|---|---|---|
| 5,287,832 | A * | 2/1994 | Uhl | 123/185.3 |
| 5,826,555 | A * | 10/1998 | Aronsson et al. | 123/185.3 |
| 6,199,529 | B1 * | 3/2001 | Kuwabara et al. | 123/179.24 |
| 6,718,931 | B2 * | 4/2004 | Morishige et al. | 123/185.3 |
| 7,028,658 | B2 * | 4/2006 | Kruse et al. | 123/185.3 |
| 7,191,752 | B2 * | 3/2007 | Schriever et al. | 123/185.3 |
| 7,234,431 | B2 * | 6/2007 | Adam et al. | 123/185.14 |
| 7,287,505 | B2 * | 10/2007 | Kruse et al. | 123/185.3 |
| 7,690,277 | B2 * | 4/2010 | Kellermann et al. | 74/7 C |
| 7,691,164 | B2 * | 4/2010 | Kellermann | 55/467 |
| 2005/0051127 | A1 | 3/2005 | Adam et al. | |
| 2005/0252477 | A1 | 11/2005 | Schriever et al. | |

OTHER PUBLICATIONS

Jun. 19, 2012 Search Report issued in Chinese Patent Application No. 200910225683.X w/translation.

Jul. 3, 2012 Office Action issued in Chinese Patent Application No. 200910225683.X w/translation.

* cited by examiner

STARTER DEVICE

The invention relates to a starter device for an internal combustion engine of a manually guided engine unit, wherein the device comprises a housing and a cable drum which can be rotated relative to the housing about a rotational axis with a starter pull for starting the engine, and has a recoil spring space, which is arranged between the housing and the cable drum, for a recoil spring, in order to move the cable drum into its original position after a rotational movement of the starter, wherein a seal is provided for sealing off the recoil spring space.

Internal combustion engines of manually guided engine units are generally started with cable pull starters. In this case a rotary movement is transferred to the crankshaft by means of a starter device consisting of a starter handle, a starter cable, a cable drum, a housing and a suitable coupling. This rotary movement is produced by pulling the starter cable away from the cable drum. The rotary movement produced thereby is transferred by means of the coupling to the fan impeller which is connected in a force-fitting manner to the crankshaft.

This fan impeller has the task of providing the internal combustion engine with enough cooling air. The volumetric flow which is conveyed in the direction of the center of the engine is taken from the environment via the housing. Depending on the application, engine type, ambient conditions etc., the ambient air can be contaminated to differing extents by for example dust or chippings. In order to guarantee functioning of the starter device in the long term, it is necessary to protect the affected components extensively from dirt.

A starter device of this type is disclosed in DE 197 25 901 A1. In this design an intermediate piece must be present between the cable drum and the ventilator housing. This forms a partition of the recoil spring space and holds a labyrinth seal. This has a pair of mutually opposite clamping jaws so that fastening to the ventilator housing is possible by means of screw fastenings. For sealing purposes a lip must also be present which surrounds the intermediate piece and thus seals off the outside of the intermediate piece as far as the ventilator housing. In addition to the wall which forms the space, there is a further, cylindrical wall which runs inwards parallel to the bearing axis. The partition extends radially inwards from a transition between a flange and the cylindrical wall. The partition forms the inner wall for the recoil spring space.

With this solution two seals are in principle required: a labyrinth seal and an outer sealing lip. An additional partition must also be attached.

The invention is based on the object of creating a starter device which on the one hand prevents dirt from penetrating into the recoil spring space and on the other hand has a simple design.

This object is achieved by a device with the features of claim 1.

The invention is based on the finding that, in a cable starter which is known per se, the cover of the recoil spring which is proposed according to DE 197 25 901 A1 can be omitted. The sealing of the installation space for the recoil spring, which is now produced between the outside of the cable drum and the inside of the housing, is sealed off according to the invention by a sealing medium between the housing and the cable drum.

The invention means that no intermediate wall is necessary between the cable drum and the recoil spring space. Instead of equipping the intermediate wall with a sealing element in order to prevent dust and other foreign material from being able to penetrate into the recoil spring space from the environment via passages between the cable drum and the recoil spring space, a sealing arrangement is placed on opposite sides directly between the housing and the cable drum. A compact construction is thus achieved owing to the optimisation of installation space.

The invention is based on the idea of moving the seal for sealing off the recoil spring space from a partition, which can now be omitted according to the invention, to the outer wall of the housing.

The invention has the advantage that the design is much simpler and therefore more cost-effective and optimised in terms of weight because fastening of an intermediate piece with screw fastenings can be omitted. In addition, two seals with sealing lips do not have to be used. It is therefore possible to use a single seal which prevents penetration of dust and the like into the recoil spring space and into the bearing point.

Further advantageous configurations of the invention are characterised in the dependent claims.

According to one development of the invention, it is provided for the cable drum to form an inner wall for the recoil spring space.

In one advantageous development of the device according to the invention it is provided for the cable drum to be provided with a connecting web which is aligned axially towards the housing and forms a wall of the cylindrical disc-shaped recoil spring space on one side and bears the seal on the other side. This embodiment simplifies the formation of the recoil spring space in that an inner face of the connecting web forms an inner outer wall of the space. The seal can be arranged relatively far outwards on a face of the connecting web which is perpendicular to the axis of rotation and on a face which is opposite the housing, so that outer protection from dust and other contamination is provided.

The cable drum is mounted in a simple manner in that the housing is provided with a bearing pin on which the cable drum is mounted.

In a further advantageous embodiment of the invention the seal is arranged radially outside the recoil spring space. Whereas the recoil spring space is situated in a central region of the cable drum, the seal is located outside the space in a separate region, viewed virtually radially. The recoil spring space and the seal are spatially separated from each other.

The cable drum is expediently configured as a spring holder for the recoil spring because an intermediate part to which the recoil spring could be fastened can then be omitted.

It is advantageous if the wall of the recoil spring space which is associated with the housing is formed by a disc-shaped covering element of the housing, which is connected in a detachable and/or non-rotating manner to a base body of the housing. This means that a flat bearing face for the recoil spring and an inner wall for the recoil spring space is created. The fastening of the covering element can be achieved in that the bearing pin has a radial web which engages in a cut-out in a bearing opening of the covering element in order to fix the latter in a non-rotating manner.

The seal can be configured as a contactless seal, in particular as a labyrinth seal, or as a sealing lip, sealing ring, rubber ring or felt ring.

According to an advantageous embodiment, the housing is formed as a ventilator housing.

It is particularly advantageous if the recoil spring is mounted in a spring cartridge which is arranged in the recoil spring space which is completely surrounded by the housing and the cable drum.

In contrast to the known prior art, only a single seal is present.

An exemplary embodiment is explained in more detail on the basis of the drawings, advantageous developments of the invention and advantages of the same being described. In the figures, in a purely schematic representation:

In the figures the same parts are given the same reference symbols.

Figure 1:
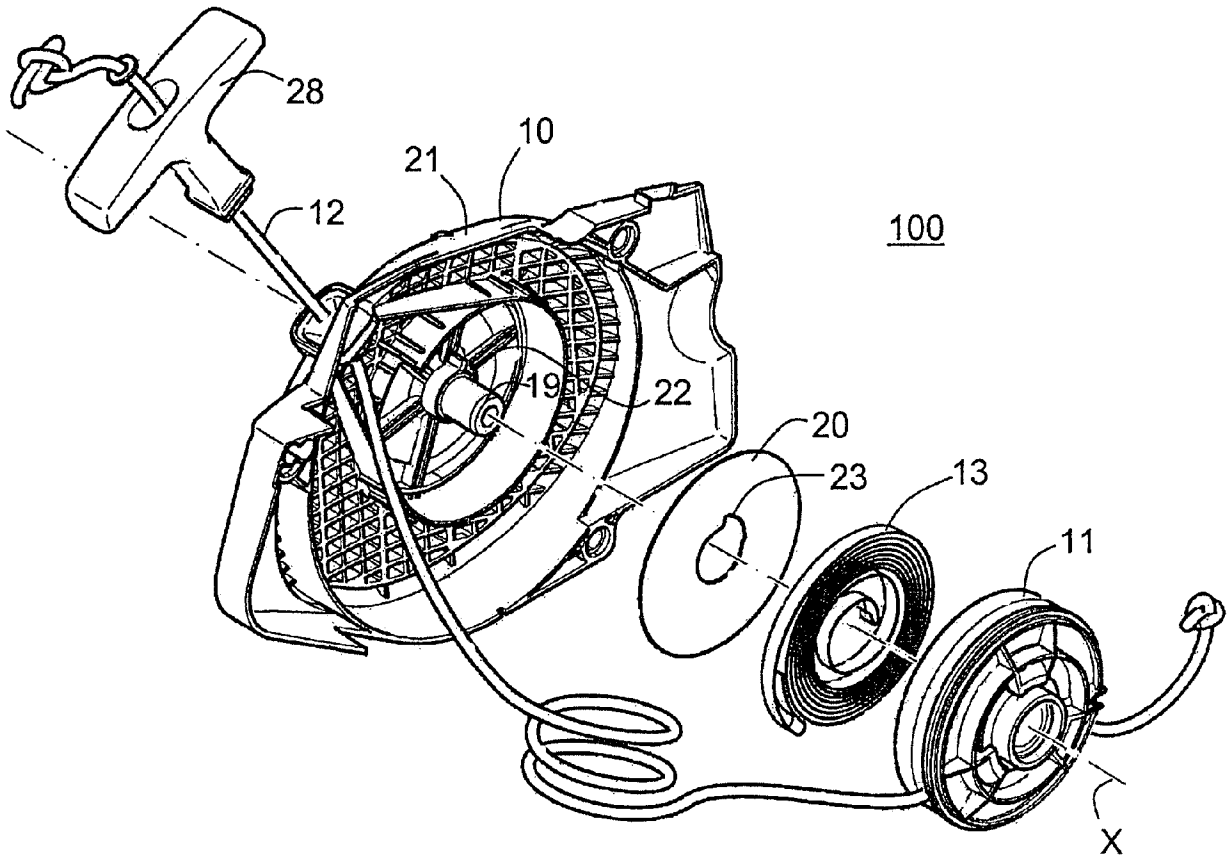
FIG. 1 shows a perspective view of a device according to the invention.

FIG. 1 shows a starter device 100 for an internal combustion engine of a manually guided engine unit, for example a power saw. The device comprises an immovable housing 10 and a cable drum 11 which can be rotated relative to the housing 10 about a rotational axis X. The cable drum is connected to a starter pull for starting the engine. To this end a cable 12 and a handle 28 are arranged in a known manner.

Figure 2:
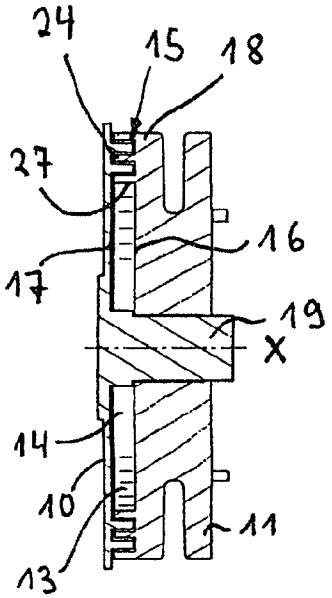
FIG. 2 shows a sectional view of a first embodiment of the device according to the invention.

As shown in FIG. 1, a recoil spring 13 is present between the housing 10 and the cable drum 11. The spring 13 is embedded in a recoil spring space 14, as can be seen in FIG. 2. The recoil spring 13 has the task of moving the cable drum 11 into its original position after a rotational starter movement.

According to the invention, a seal 15 is situated directly between the cable drum 11 and the housing 10 for sealing the recoil spring space 13 to prevent dust, chippings or other dirt from penetrating into the space 14 or even into the bearing. The seal 15 is thus spaced radially apart from the rotational axis X to such an extent that the recoil spring space 13 is formed by a wall 16 of the cable drum 11 and an approximately opposite wall 17 of the housing 10. The cable drum 11 forms according to the invention an inner wall 16 for the recoil spring space 14. The seal 15 is also arranged radially outside the recoil spring space. The cable drum is configured as a spring holder for the recoil spring.

As shown further in FIG. 2, the cable drum 11 is provided with a connecting web 18 which is directed axially towards the housing 10. This web forms a wall 27 of the cylindrical disc-shaped recoil spring space 14 on one side and bears the seal on the other side.

For mounting purposes the housing 10 is provided with a bearing pin 19 on which the cable drum 11 is mounted.

FIG. 1 shows a covering element 20, with this belonging to the housing 10. The housing 10 thus consists of a base body 21 and the covering element 20. The wall 17 of the cable drum which is associated with the housing 10 is formed by a disc-shaped covering element of the housing which is connected in a detachable and non-rotating manner to a base body of the housing. The bearing pin 19 has a radial web 22 which engages in a cut-out 23 in a bearing opening of the covering element 20 in order to fix the latter in a non-rotating manner.

In an embodiment shown in FIG. 2, the seal is configured as a labyrinth seal 24. A labyrinth seal means a contactless seal, the sealing effect of which is based on the sealing gap being relatively long and at the same time extremely narrow, so that in the present case the ingress of dirt is largely reduced. The cable drum 11 is provided with labyrinth webs which are directed axially in the direction of the housing 10 and dip into annular grooves formed on the housing 10.

Figure 3:
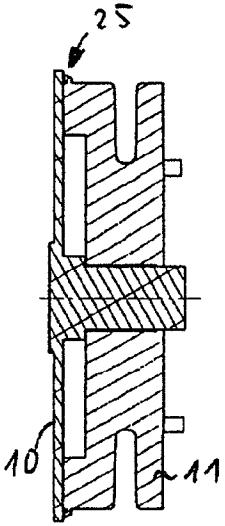
FIG. 3 shows a sectional view of a second embodiment of the device according to the invention.

In another embodiment which is shown in FIG. 3, the seal comprises at least one sealing lip 25. This is arranged in the region of the outer edge of the cable drum 11.

Figure 4:
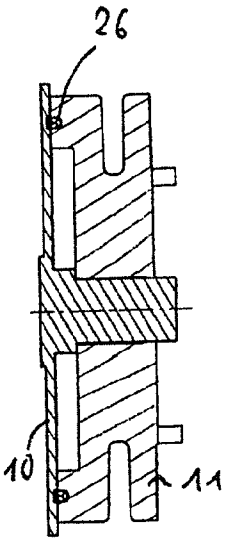
FIG. 4 shows a sectional view of a third embodiment of the device according to the invention.

FIG. 4 shows a variant in which the seal comprises at least one annular seal 26 such as a rubber ring, felt ring or radial shaft seal. This is embedded in an annular groove which is directed towards the housing 10.

Figure 5:
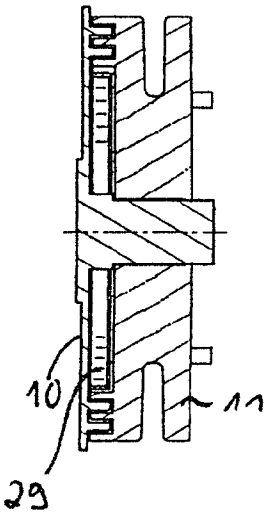
FIG. 5 shows a sectional view of a fourth embodiment of the device according to the invention.

FIG. 5 shows a variant, the basic structure of which corresponds to the embodiment according to FIG. 2, but in which an inner spring cartridge 29 is provided.

The above-described starting system is provided with a recoil spring 13 which effects rewinding of the starter cable onto the cable drum 11 and thus rotating back into the original position after every individual starting attempt. This also means that further rapidly successive starting attempts are possible and that the unwound starter cable is pulled back into the cable drum immediately after every starting attempt so that it does not become caught in moving parts.

Owing to the explained design, the functioning of the recoil spring 13 can be ensured and the latter can be in particular protected from dirt.

The recoil spring 11 is practically not encapsulated in a separate spring cassette, but to be positioned in the contour of the spring space between the cable drum and the housing. This means that sealing can take place between the housing 10 and the cable drum 11 which protects the recoil spring 13 from dirt before action.

The invention is not limited to this example, for instance, although only one seal is present in each case in the figures, a plurality of seals, for example two annular seals or a combination of seals, for example a labyrinth seal and a sealing lip, can be used.

LIST OF REFERENCE SYMBOLS

10 Housing
11 Cable drum
12 Cable/starter cable
13 Recoil spring
14 Recoil spring space
15 Seal
16 First wall
17 Second wall
18 Connecting web
19 Bearing pin
20 Covering element
21 Base body
22 Radial web
23 Cut-out
24 Labyrinth seal
25 Sealing lip
26 Annular seal
27 Third wall
28 Handle/starter handle
29 Inner spring cartridge
100 Starter device
X Axis of rotation

What is claimed is:

1. A starter device for an internal combustion engine of a manually guided engine unit, the starter device comprising:

a housing;

a cable drum which can be rotated relative to the housing about a rotational axis with a starter pull for starting the engine; and a recoil spring space, which is arranged between the housing and the cable drum, for a recoil spring provided in order to move the cable drum into its original position after a rotational movement of the starter, wherein a seal provides sealing of the recoil spring space, the seal being spaced apart radially from the rotational axis to such an extent that the recoil spring space is formed by a wall of the cable drum and an approximately opposite wall of the housing, wherein the cable drum is provided with a connecting web, which is directed axially towards the housing and forms a wall of the cylindrical disc-shaped recoil spring space, the seal is a labyrinth seal, formed by a plurality of connecting parts, and no intermediate wall is provided between the cable drum and the recoil spring space.

2. The starter device according to claim 1, wherein the cable drum forms an inner wall for the recoil spring space.

3. The starter device according to claim 1, wherein the seal is arranged radially outside the recoil spring space.

4. The starter device according to claim 1, wherein the cable drum is configured as a spring holder for the recoil spring.

5. The starter device according to claim 1, wherein the wall of the recoil spring space which is associated with the housing is formed by a disc-shaped covering element of the housing which is connected in a detachable and/or non-rotating manner to a base body of the housing.

6. The starter device according to claim 5, wherein a bearing pin has a radial web which engages in a cut-out in a bearing opening of the covering element in order to fix the covering element in a non-rotating manner.

7. The starter device according to claim 1, wherein the cable drum is provided with labyrinth webs which are directed axially in the direction of the housing and dip into annular grooves which are formed on the housing.

8. The starter device according to claim 1, wherein the housing is provided with labyrinth webs which are directed axially in the direction of the cable drum and dip into annular grooves which are formed on the cable drum.

9. The starter device according to claim 1, wherein a sealing lip which is arranged on an outer edge of the cable drum is present.

10. The starter device according to claim 1, wherein a single seal is present.

11. The starter device according to claim 1, wherein the housing is configured as a ventilator housing.

12. The starter device according to claim 1, wherein the recoil spring is mounted in a spring cartridge which is arranged in the recoil spring space which is completely surrounded by the housing and the cable drum.

* * * * *